United States Patent [19]

Watanabe

[11] Patent Number: 4,892,024

[45] Date of Patent: Jan. 9, 1990

[54] STRUCTURE OF KEYBOARD USED IN ELECTRONIC KEYBOARD INSTRUMENT

[75] Inventor: Keisuke Watanabe, Shizuoka, Japan

[73] Assignee: Yamaha Corporation, Hamamatsu, Japan

[21] Appl. No.: 228,230

[22] Filed: Aug. 4, 1988

[30] Foreign Application Priority Data

Aug. 7, 1987 [JP] Japan ..... 62-197791

[51] Int. Cl.[4] ..... G10H 1/00; G10C 3/12

[52] U.S. Cl. ..... 84/719; 84/423 R; 84/433; 84/DIG. 7

[58] Field of Search ..... 84/DIG. 7, 1.14, 1.01, 84/1.16, 423 A, 423 B, 423 R, 433–436, 1.1, 1.11, 423

[56] References Cited

U.S. PATENT DOCUMENTS

| | | | |
|---|---|---|---|
| 3,708,605 | 1/1973 | Ohno | 84/1.1 |
| 3,797,357 | 3/1974 | Thomas et al. | 84/DIG. 7 |
| 4,043,244 | 8/1977 | Schrecongost et al. | 84/434 X |
| 4,079,651 | 3/1978 | Matsui | 84/1.1 |
| 4,186,638 | 2/1980 | Lijima | 84/DIG. 7 |
| 4,321,851 | 3/1982 | Adachi | 84/1.01 |
| 4,416,178 | 11/1983 | Ishida | 84/DIG. 7 |
| 4,488,472 | 12/1984 | Kumano et al. | 84/436 X |
| 4,653,378 | 3/1987 | Watanabe et al. | 84/423 R |

FOREIGN PATENT DOCUMENTS

| | | | |
|---|---|---|---|
| 54-33718 | 3/1979 | Japan | 84/DIG. 7 |

*Primary Examiner*—A. T. Grimley
*Assistant Examiner*—Matthew S. Smith
*Attorney, Agent, or Firm*—Burns, Doane, Swecker, & Mathis

[57] ABSTRACT

There is disclosed a keyboard structure incorporated in an electronic keyboard instrument the keyboard structure including; a plurality of key members each having a depressible front end portion and a rear end portion; a plurality of flexible connecting members each merged with the rear end portion of each key member; a retainer member merged with the flexible connecting members for retaining a circuit board which carries a plurality of key switches; and a plurality of coupling members each having a first element merged with the rear end portion of each key member and a second element merged with the retainer member, and the first element is snapped into the second element, so that major members are simultaneously formed by a molding, thereby enhancing the assembling efficiency.

20 Claims, 4 Drawing Sheets

PRIOR-ART

STRUCTURE OF KEYBOARD USED IN ELECTRONIC KEYBOARD INSTRUMENT

FIELD OF THE INVENTION

This invention relates to an electronic keyboard instrument and, more particularly, to the structure of a keyboard incorporated in the electronic keyboard instrument.

BACKGROUND OF THE INVENTION

A typical example of the key forming part of the keyboard of the electronic keyboard instrument is illustrated in FIG. 1. The key 1 is provided on a framework 2 of a metal in such a manner as to be rockable with respect to the framework 2. In detail, the framework 2 comprises a flat portion 3 formed with an opening 4, a front guide portion 5 formed with a vertical slit 6 and a rear vertical portion 7 providing a fulcrum for the key 1. The flat portion 3 supports a print-circuit board 8 with connecting rods 9 and 10, and an electrical switch 11 is provided on the printcircuit board 8 in such a manner as to be located beneath the opening 4. The electrical switch 11 has a pair of contacts of a conductive rubber electrically isolated from each other by a non-conductive rubber, so that the contacts are brought into contact with each other when a compressive force is exerted thereon.

The key 1 comprises a flat upper plate 12 where the player touches, a rear notch portion 13 merged with the flat upper plate 12, and a front guide plate 14 downwardly projecting from the lower surface of the flat upper plate 12 and loosely inserted in the vertical slit 6. A compression spring 15 is provided between the notch portion 13 and the flat portion 3, so that the rear notch portion 13 is urged to be pivotally connected to the rear vertical portion 7. However, when the flat upper plate 12 is pressed by the player, the key 1 is rockably moved toward the framework 2 against the compression spring 15 with a guidance of the front guide portion 5. The key 1 further comprises a pusher 16 downwardly projecting from the lower surface of the flat upper plate 12, and the leading end of the pusher 16 is located above the electrical switch 11. Then, when the key 1 is pressed, the pusher 16 is brought into contact with the electrical switch 11 and, then, a conduction path is established therebetween. The flat upper plate 12, the rear notch portion 13, the front guide plate 14 and the pusher as a whole is molded from a synthetic resin to form the key 1, however the key 1 is physically separated from the framework 2. Then, the individual keys should be assembled to the framework 2 while inserting the compression springs between the keys and the framework 2 for completing the keyboard.

A problem is encountered in the prior-art keyboard in complexity in construction due to a large number of parts and, accordingly, in time-consuming and elaborate labor for assemblage.

SUMMARY OF THE INVENTION

It is therefore an important object of the present invention to provide a structure of a keyboard which is constituted by a relatively small number of parts.

It is also an important object of the present invention to provide a structure of a keyboard which is easy for assemblage.

To accomplish these objects, the present invention proposes to provide key members respectively merged with flexible coupling members which in turn are merged with a retaining member for a circuit board.

In accordance with the present invention, there is provided a keyboard structure incorporated in an electronic keyboard instrument, comprising: (a) a plurality of key members each having a front end portion and a rear end portion, the front end portion being depressed by a player of the electronic keyboard instrument; (b) a plurality of flexible connecting members each merged with the rear end portion of each key member; (c) a retainer member for retaining a circuit board and being merged with each of the flexible connecting members which connects the retainer member and the key member; and (d) a plurality of key switches disposed on the circuit board, the retainer member retaining the circuit board so that each of the key switches opposes associated one of the key members.

BRIEF DESCRIPTION OF THE DRAWINGS

The features and advantages of a keyboard structure according to the present invention will be more clearly understood from the following description taken in conjunction with the accompanying drawings in which.

DESCRIPTION OF THE PREFERRED EMBODIMENTS

First Embodiment

Figure 1:
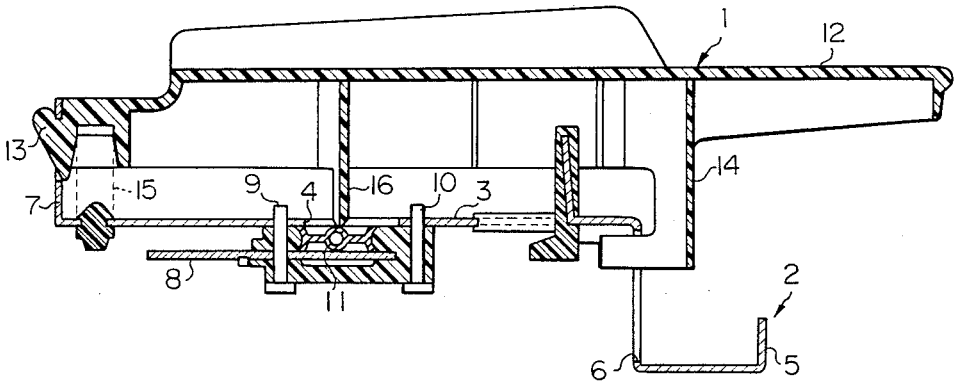
FIG. 1 is a cross sectional view showing the structure of a key incorporated in a prior-art keyboard.
Figure 2:
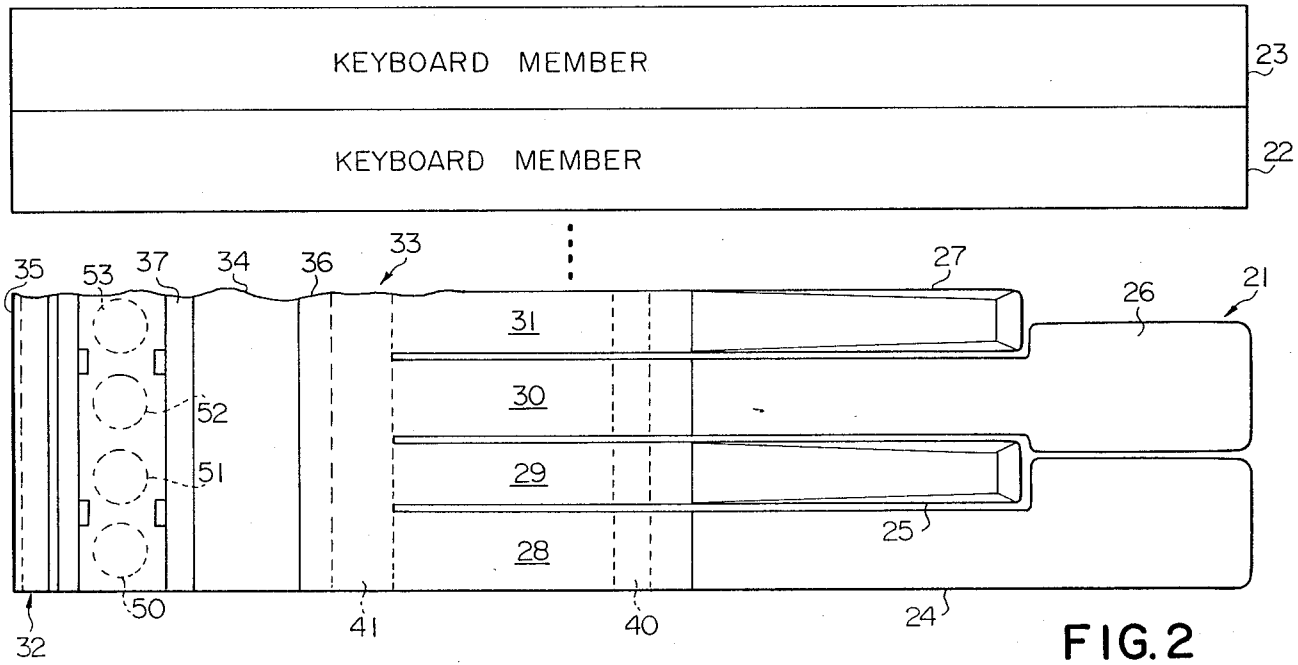
FIG. 2 is a plan view showing a keyboard structure embodying the present invention in a spread state.

Referring first to FIG. 2 of the drawings, there are shown keyboard members 21, 22 and 23 used for formation of a keyboard incorporated in an electronic keyboard instrument. Each of the keyboard members 21, 22 and 23 is in a spread state just taken out from a molding apparatus, so that the keyboard members should be assembled prior to arrangement on a framework (not shown) of the electronic keyboard instrument. All of the keyboard members 21, 22 and 23 are identical in structure to one another, so that description will be herein under made for the keyboard member 21 only.

The keyboard member 21 largely comprises a plurality of key members 24, 25, 26 and 27, a plurality of flexible connecting members 28, 29, 30 and 31, a retainer member 32, and a snap unit 33, and the keys are merged with one another at the rear ends thereof. The keyboard member 21 is molded from a synthetic resin, so that all of the key members, the flexible connecting members, the retainer member and the snap unit 33 are integrally merged with the keyboard member 21. The key members 24 and 26 serve as white keys, but the key members 25 and 27 serve as black keys, so that the key members 24 and 26 are larger in length but smaller in height than the key members 25 and 27. The key members 24 to 26 are merged with the flexible connecting members 28 to 31, respectively, and each of the flexible connecting members 28 to 31 has a extremely small thickness, so that the flexible connecting members 28 to 31 are easy for bending upon assemblage. The retainer member 32 is used for supporting a print-circuit board 34 and has front and rear bar portions 35 and 36 and an intermediate bar portion 37. As will be better seen from FIG. 3, the front and rear bar portions 35 and 36 are formed with respective grooves 38 and 39 where side edges of the print-circuit board 34 are respectively inserted.

Turning back to FIG. 2, the snap unit 33 is provided with a bar member 40 and a pawl member 41 both extending over the width of the keyboard member. However, the bar member 40 and the pawl member may be separated into a plurality of first elements and a plurality of second elements, respectively, which are paired to allow each pair to be in association with each of the key members 24 to 27. The bar member 40 has a boss portion projecting from the key members 24 to 27 and a leading end portion which is larger in width than the boss portion as will be seen from FIG. 3. On the other hand, the pawl member 41 has two pawls 42 and 43 which are slightly bent to reduce a space therebetween, so that the leading end of the bar member 40 can be snapped into the space between the two pawls 42 and 43, thereby placing the print-circuit board 34 under the key members 24 to 27.

Figure 3:
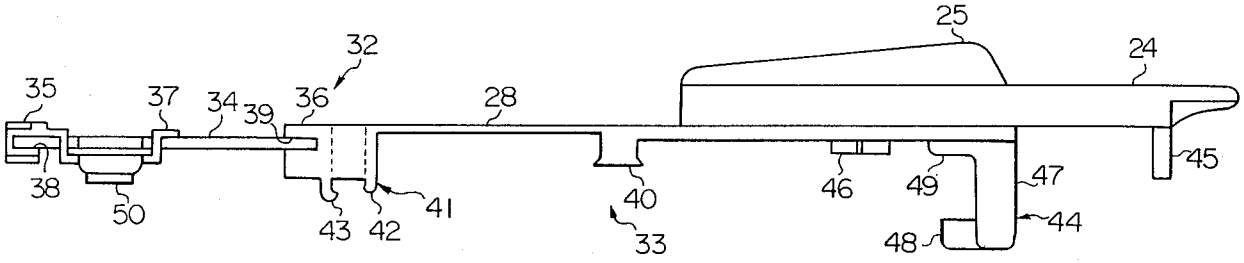
FIG. 3 is a side view showing the keyboard structure illustrated in FIG. 2.

The keyboard member further comprises a plurality of stopper members, a plurality of guide members and a plurality of pushing members, and each stopper member, each guide member and each pushing member are merged with each key member, however FIG. 3 shows only one set of these members for the key member 24 denoted by reference numerals 44, 45 and 46, respectively. The stopper member 44 has a stem portion 47 projecting from the key member 24 and two lateral protrusions 48 and 49 projecting from the stem portion 47 and spaced apart from each other by a distance approximately equal to a traveling length of the key member 24 upon pressing. The guide member 45 cooperates with a guide slot (not shown) and is provided for restriction of lateral movement of the key member 24. On the print-circuit board 34 are provided a plurality of electric switches 50, 51, 52 and 53 which are dedicated to the key members 24 to 27, respectively, for detecting the travelings thereof. For pushing the electric switches 50 to 53, the pushing members are respectively provided for the key members 24 to 27. Each of the pushing members such as the pushing member 46 has two plates crossing each other and is located in such a manner to be confronted with the electric switch when the keyboard member is assembled. Though not shown in the drawings, the print-circuit board 34 has a plurality of conductive strips printed thereon, and each of the electric switches 50 to 53 is constituted by a contact supported by a frusto-conical rubber body. Then, when the frusto-conical rubber body is deformed by application of a force, the contact is downwardly moved to short-circuit a pair of the conductive strips. However, in another implementation, a rubber switch such as, for example, the electric switch 11 is employed therein.

Description will be herein under made for the assemblage. As described above, each of the keyboard members 21 to 23 is taken out from the molding apparatus in the spread state. Then, assembling work is necessary.

First, the print-circuit board 34 with the electric switches 50 to 53 is assembled to the keyboard member 21 while inserting the side edges of the print-circuit board 34 into the slots 38 and 39.

Figure 4:
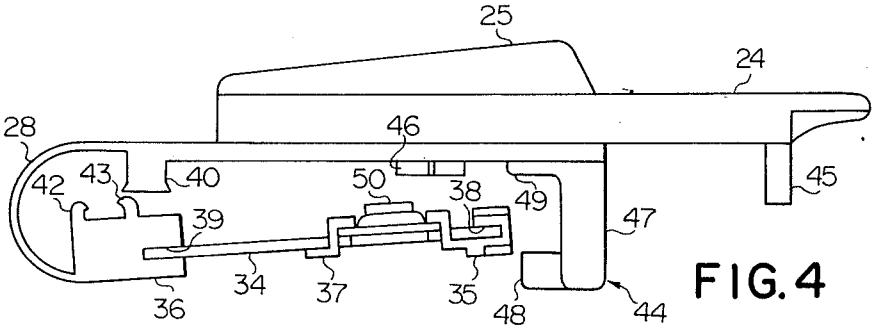
FIG. 4 is a side view showing the keyboard structure illustrated in FIG. 2 in an intermediate stage during the assemblage.
Figure 5:
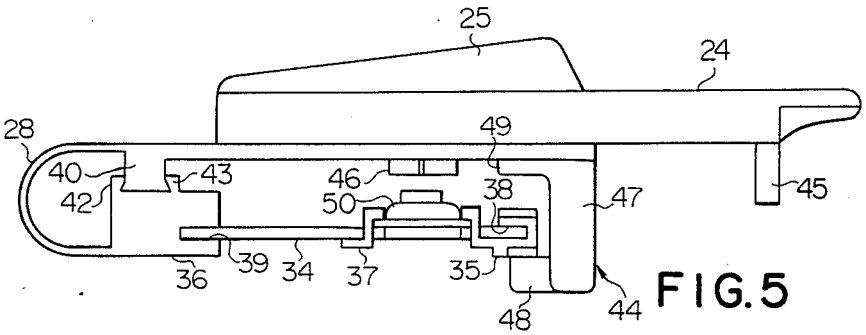
FIG. 5 is a side view showing the keyboard structure illustrated in FIG. 2 upon completion of the assemblage.

Next, the keyboard member 21 is bent to cause the key members 24 to 27 to confront with the print-circuit board 34. In this stage, the key members 24 to 27 are slightly deviated from those right positions as illustrated in FIG. 4, so that the lateral protrusion 48 can be moved beyond the front bar portion 35.

Finally, the key members 24 to 27 are rearwardly pushed, so that the bar member 40 is snapped into the space between the pawls 42 and 43 and the front bar portion 35 is placed between the two lateral protrusions 48 and 49 of each key member. Thus, the key member 21 is assembled by three stages, and any parallel operations such as the fitting the key to the framework while inserting the spring are not needed during the assemblage. This results in easy for assembling.

After completion of the electronic keyboard instrument, the player presses the key members for specifying tones to make a melody. For example, when the player presses the key member 24, the key member 24 is deformed with respect to the bar member 40 and, accordingly, the pushing member 46 is downwardly moved toward the electric switch 50. With the force applied by the pushing member 46, the electric switch 50 provides a current path between the conductive strips, so that a tone generator circuit (not shown) produces a tone signal representing the tone specified by the player.

Second Embodiment

Figure 6:
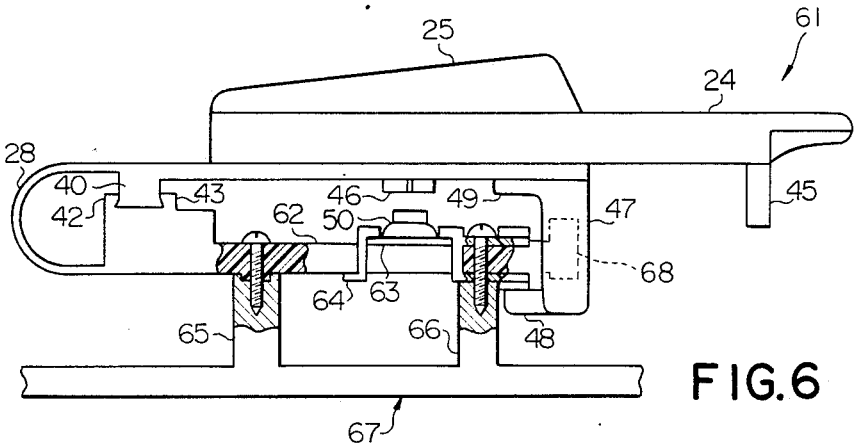
FIG. 6 is a side view showing another keyboard structure embodying the present invention.

Turning to FIG. 6 of the drawings, another keyboard member 61 is illustrated. The keyboard member 61 is similar in structure to the keyboard member 21 except for the retainer member 62. For this reason, members and portions of the keyboard member 61 are denoted by like reference numerals designating the corresponding members and portions of the keyboard member 21, and no description is incorporated for these members and the portions. The retainer member 62 is formed by a single relatively thick plate which is stiff enough to support the key members 24 to 27. A flexible film 63 is provided on the retainer member 62, and a conductive pattern is formed on the flexible film 63. Then, the electric switches 50 to 53 are provided on the flexible film 63 for detection of the key movement. The flexible film 63 is fastened to the retainer member 62 by an elastic member 64, and the thick retainer member 62 is secured to boss portions 65 and 66 of a framework 67. In this instance, a guide plate 68 is formed at the front end of the retainer member 62, and the guide plate 68 is conducive to restrict the lateral movement of the key member 24. The guide plate is merged into the keyboard member 21, so that no additional assembling work is necessary.

Although particular embodiment of the present invention have been shown and described, it will be obvious to those skilled in the art that various changes and modifications may be made without departing from the spirit and scope of the present invention.

What is claimed is:

1. A keyboard structure incorporated in an electronic keyboard instrument, comprising:

(a) a plurality of key members each having a front end portion and a rear end portion, said front end portion being depressed by a player of said electronic keyboard instrument;

(b) a plurality of flexible connecting members each coupled to the rear end portion of each key member;

(c) a retainer member for retaining a circuit board and being coupled to each of said flexible connecting members which connects the retainer member and said key member; and (d) a plurality of key switches disposed on said circuit board, said retainer member retaining said circuit board so that each of said key switches opposes associated one of said key members, wherein said key members, said flexible connecting members and the retainer member are formed into a singular piece.

2. A keyboard structure as set forth in claim 1, in which said keyboard structure further comprises a plurality of coupling members each having a first element provided in the rear end portion of each key member and a second element provided in said retainer member, said first element being coupled with said second element.

3. A keyboard member as set forth in claim 2, in which said key members have a plurality of white keys and a plurality of black keys.

4. A keyboard as set forth in claim 3, in which said key members, said flexible connecting members, said retainer member and said coupling members are formed of a synthetic resin.

5. A keyboard structure as set forth in claim 2, in which all of said first elements are formed by a bar member and all of said second elements are formed by a pawl member.

6. A keyboard structure as set forth in claim 5, said bar member has a boss portion and a leading end portion larger in width than the boss portion and in which said pawl member has two pawls capable of being in mating engagement with the leading end portion of said bar member.

7. A keyboard structure as set forth in claim 2, in which said first element and said second element are formed into said singular piece.

8. A keyboard structure as set forth in claim 1, in which each of said flexible connecting members is similar in thickness than each of said key members, said flexible connecting members being deformable so as to cause each of said key switches to oppose to each of said key members.

9. A keyboard structure as set forth in claim 1, in which said retainer member is formed with two grooves having respective open ends confronted with each other and in which said circuit board has two side edges inserted into said grooves, respectively.

10. A keyboard structure as set forth in claim 1, in which said keyboard structure further comprises a plurality of stopper members each provided in the front end portion of each key member, each of said stopper members being capable of restricting a traveling length of the front end portion of each key member upon depression thereof.

11. A keyboard structure as set forth in claim 10, in which each of said stopper members has a stem portion projecting from the front end portion of each key member and two lateral protrusions projecting from the stem portion and spaced apart from each other, one of said lateral protrusions being brought into abutting engagement with an upper surface of said retainer member when the front end portion of each key member is depressed, the other protrusion being brought into abutting engagement with a lower surface of said retainer member when the front end portion of each key member is moved back.

12. A keyboard structure as set forth in claim 9, in which said stopper members are formed into said singular piece.

13. A keyboard structure as set forth in claim 1, in which said keyboard structure further comprises a plurality of guide members each formed in the front end portion of each key member.

14. A keyboard structure as set forth in claim 11, in which said guide members are formed into said singular piece.

15. A keyboard structure as set forth in claim 1, in which said keyboard structure further comprises a plurality of pushing members each formed in the front end portion of each key member, each of said pushing members being brought into abutting engagement with each of said key switches when the front end portion of each key is depressed.

16. A keyboard structure as set forth in claim 12, in which said pushing members are formed into said singular piece.

17. A keyboard structure as set forth in claim 1, in which said retainer member is connected to a framework and is stiff enough to support the key members.

18. A keyboard structure as set forth in claim 17, in which an electric conductive strips are patterned on a flexible film which is supported by said retainer member, said flexible film and said electric conductive strips as a whole serving as said circuit board.

19. A keyboard member forming part of a keyboard incorporated in an electronic keyboard instrument, comprising:

(a) a plurality of key members serving as white keys and black keys, each key member having a front end portion and a rear end portion, said front end portion being resiliently deformable when a force is exerted thereon;

(b) a plurality of flexible connecting members each coupled to the rear end portion of each key member, each of said flexible connecting members being formed by a plate smaller in thickness than each of said key members;

(c) a retainer member for a circuit board coupled to said flexible connecting members and formed with two grooves having respective open ends confronted with each other, said circuit board having two side edges inserted into said grooves, respectively, a plurality of key switches being provided on said circuit board in association with said key members;

(d) a coupling unit having a bar member provided in the rear end portion of each key member and a pawl member provided in said retainer member, said bar member having a boss portion and a leading end portion larger in width than the boss portion, said pawl member having two pawl portions capable of being in mating engagement with the leading end portion of said bar member;

(e) a plurality of stopper members each provided in the front end portion of each key member, each of said stopper members having a stem portion projecting from the front end portion of each key member and two lateral protrusions projecting from the stem portion and spaced apart from each other, one of said lateral protrusions being brought into abutting engagement with an upper surface of said retainer member when the front end portion of each key member is deformed, the other protrusion being brought into abutting engagement with a lower surface of said retainer member when the front end portion of each key member is resiliently restored, thereby restricting a traveling length of the front end portion of each key member;

(f) a plurality of guide members each provided in the front end portion of each key member; and (g) a plurality of pushing members each provided in the front end portion of each key member and having two plates intersecting each other, each of said pushing members being brought into abutting engagement with each of said key switches when the front end portion of each key is deformed, wherein said key members, said flexible connecting members, said retainer member, said coupling members, said stopper members, said guide members and pushing members are formed of a synthetic resin and into a singular piece.

20. A keyboard member forming part of a keyboard incorporated in an electronic keyboard instrument, comprising:

(a) a plurality of key members serving as white keys and back keys, each key member having a front end portion and a rear end portion, said front end portion being resiliently deformable when a force is exerted thereon;

(b) a plurality of flexible connecting members each coupled to the rear end portion of each key member, each of said flexible connecting members being formed by a plate smaller in thickness than each of said key members;

(c) a retainer member for a flexible film coupled to said flexible connecting members, electrical conductive strips being patterned on said flexible film and accompanied by a plurality of key switches in association with said key members, said retainer member being secured to a framework and stiff enough to support said key members;

(d) a coupling unit having a bar member provided in the rear end portion of each key member and a pawl member provided in said retainer member, said bar member having a boss portion and a leading end portion larger in width than the boss portion, said pawl member having two pawls capable of being in mating engagement with the leading end portion of said bar member;

(e) a plurality of stopper members each provided in the front end portion of each key member, each of said stopper members having a stem portion projecting from the front end portion of each key member and two lateral protrusions projecting from the stem portion and spaced apart from each other, one of said lateral protrusions being brought into abutting engagement with an upper surface of said retainer member when the front end portion of each key member is deformed, the other protrusion being brought into abutting engagement with a lower surface of said retainer member when the front end portion of each key member is resiliently restored, thereby restricting a traveling length of the front end portion of each key member;

(f) a plurality of guide members each provided in the front end portion of said retainer member for restricting a lateral movement of each key member; and (g) a plurality of pushing members each provided in the front end portion of each key member and having two paltes crossing each other, each of said pushing members being brought into abutting engagement with each of said key switches when the front end portion of each key is deformed, wherein said key members, said flexible connecting members, said retainer member, said coupling members, said stopper members, said guide members and pushing members are formed of a synthetic resin and into a singular piece.

* * * * *